United States Patent [19]

Salmi

[11] 4,451,360

[45] May 29, 1984

[54] DEVICE FOR REMOVAL OF MAGNETIC PARTICLES FROM A MAGNETIC SEPARATOR

[75] Inventor: Robert W. Salmi, Township of Arbo, County of Itasca, Minn.

[73] Assignee: United States Steel Corporation, Pittsburgh, Pa.

[21] Appl. No.: 342,561

[22] Filed: Jan. 25, 1982

[51] Int. Cl.[3] ..... B03C 1/18; B03C 1/30

[52] U.S. Cl. ..... 209/230; 209/225; 209/215

[58] Field of Search ..... 209/230, 229, 225, 215; 55/100, 290

[56] References Cited

U.S. PATENT DOCUMENTS

| | | | |
|---|---|---|---|
| 912,363 | 2/1909 | Charlton | 209/219 |
| 1,177,981 | 4/1916 | Wright | 209/229 X |
| 1,630,987 | 5/1927 | Turner | 209/215 |
| 2,253,362 | 8/1941 | Broekhuysen | 209/215 |
| 2,268,128 | 12/1941 | Reeves | 209/229 X |
| 2,673,647 | 3/1954 | Haley et al. | 209/215 |

FOREIGN PATENT DOCUMENTS

| | | | |
|---|---|---|---|
| 38367 | 1/1913 | Denmark | 209/230 |
| 362124 | 12/1931 | United Kingdom | 209/230 |
| 2069033 | 8/1981 | United Kingdom | 209/215 |

*Primary Examiner*—Kathleen J. Prunner

*Attorney, Agent, or Firm*—George D. Dickos

[57] ABSTRACT

An apparatus for removing adherent magnetically attracted particles from the surface of the magnetic head pulley of the conveyor belt used in a dry magnetic separator without disrupting the magnetic separation process. An array of magnetically soft iron tines of several sizes is provided to be moved into and out of close proximity with and substantially normal to the magnetic head pulley surface. When in proximity to the magnetic head pulley, the soft iron tines are induced with a magnetic force and because of their shape, a magnetic field gradient is formed in the direction of the tines having a force sufficient to attract the particles from the head pulley to the tines. When the tines are moved away from proximity with the head pulley, they lose most of their induced magnetism and the attracted particles fall into a discharge chute or collection box.

20 Claims, 5 Drawing Figures

FIGURE I

DEVICE FOR REMOVAL OF MAGNETIC PARTICLES FROM A MAGNETIC SEPARATOR

DESCRIPTION OF THE INVENTION BACKGROUND

The present invention relates to magnetic particle separation and, in particular, to an apparatus for removing magnetic particles which have become entrained on the surface of the magnetic head pulley of a conveyor belt which is used for dry magnetic particle separation.

Various methods of separating ore particles containing the minerals Magnetite, Franklinite, Ilmenite, Pyrrotite, and artificial magnetite or other magnetically attractable minerals or scrap iron from associated non-magnetic particles by magnetic separation are known. One type of magnetic separation is the dry concentration method in which the characteristic of magnetic attractability of the material to be separated is advantageously utilized to separate it from the essentially non-magnetic portion referred to as tailings. The material to be separated, for example crushed magnetic crude ore, is placed on a continuously moving conveyor belt whose final or head pulley contains an internal magnet means. When the crushed ore particles reach the discharge end of the conveyor belt at the magnetic belt head pulley, the particles containing a high percentage of magnetically attractable material are magnetically drawn to and held onto the belt surface until the force of the magnet means is not sufficient to continue to restrain the particles. The ore particles containing successively lower percentages of magnetically attractable material are less strongly attracted to the magnetic head pulley and break away more readily from the belt surface. Thus, a non-magnetic particle will follow a normal trajectory from the belt as it will not be influenced by the magnet means while particles containing some magnetically attractable material will be discharged in a path deflected by and closer to the magnetic field. The exact path of such particles is determined by a combination of the centrifugal force due to the particles' velocity and the extent of magnetic force applied to the particle due to its content of magnetic material.

A splitter device is positioned in the stream of discharged ore particles to divide the particles into magnetic concentrates and very weakly magnetic tailings or waste on the basis of the distance the materials are deposited from the head pulley.

During the dry magnetic concentration process some magnetic ore particles fall from the belt surface, may bounce off of adjacent structures, be captured by the magnetic field and become attached to the surface of the magnetic head pulley. Magnetic dust particles that pass near the magnetic field are also held to the surface of the pulley. This buildup of particles has several adverse effects on the dry concentration process. For example, the conveyor belt is harmed and can be destroyed by the intrusion of the particles between the belt and the head pulley. Another serious problem is the resulting change in the effective magnetic attractive force on the particles which alters the discharge pattern from the conveyor belt with a resulting drop in efficiency of the separator. Yet another problem is the belt failing to track straight on the head pulley thus causing material spillage or belt damage. In addition, the adhesive means between the head pulley and belt or the head pulley surface may be damaged by particle abrasion.

Currently, when magnetic particles become attached to the surface of a magnetic head pulley the separation process must be halted to remove the particles. To clean a permanent magnet head pulley the conveyor belt must be stopped and the particles manually removed by wiping the head pulley with a non-magnetic scraping means. The conveyor belt must then be incrementally advanced to clean the entire head pulley surface by repeating the above procedure. If the magnet means in the head pulley is electromagnetic, the feed must be terminated, the separation process halted, and the electromagnet must be deenergized to release the magnetic particles from the pulley surface, and the particles must be removed.

The subject invention is directed toward an improved means for removing adherent particles from the surface of the magnetic head pulley of a dry belt-type magnetic separator which overcomes, among others, the above discussed problems and provides a cleaning apparatus which is effective in the removal of various sizes of adherent particles yet does not necessitate the cessation of the separation process.

SUMMARY OF THE INVENTION

In accordance with the present invention, there is provided apparatus for removing adherent magnetically attracted particles from the surface of a magnetic head pulley used in a dry magnetic separator. The particle removing or cleaning apparatus provided is disposed between the lengths of the continuously moving conveyor belt of a magnetic separator and in close proximity to the magnetic head pulley. An array of magnetically soft iron tines of various sizes is provided to be moved into and out of adjacent proximity with and substantially normal to the head pulley surface. The tines vary in diameter from that of thin wire bristles to rods which may be up to four inches in diameter. When in proximity to the magnetic head pulley, the tines are magnetically induced with a magnetic force and magnetic field gradient sufficient to attract the particles from the head pulley surface to the tines. Following attraction of a sufficient amount of particles, the tines are moved to a discharge position that is remote from the magnetic field at which point the particles fall from the tines because the tines lose any induced magnetism.

Accordingly, the present invention provides solutions to the aforementioned problems present in the dry cobbing process. As this invention provides an effective means of removing entrained particles from between the surface of a magnetic head pulley and its conveyor belt, the problems caused by the entrained particles are alleviated. In addition, as the present invention permits cleaning of the head pulley while the separator is operating, the separation process need not be halted during the cleaning procedure.

These and other details, objects, and advantages of the invention will become apparent as the following description of the present preferred embodiment thereof proceeds.

BRIEF DESCRIPTION OF THE DRAWINGS

In the accompanying drawings, I have shown a present preferred embodiment of the invention wherein.

DETAILED DESCRIPTION OF THE INVENTION

Figure 1:
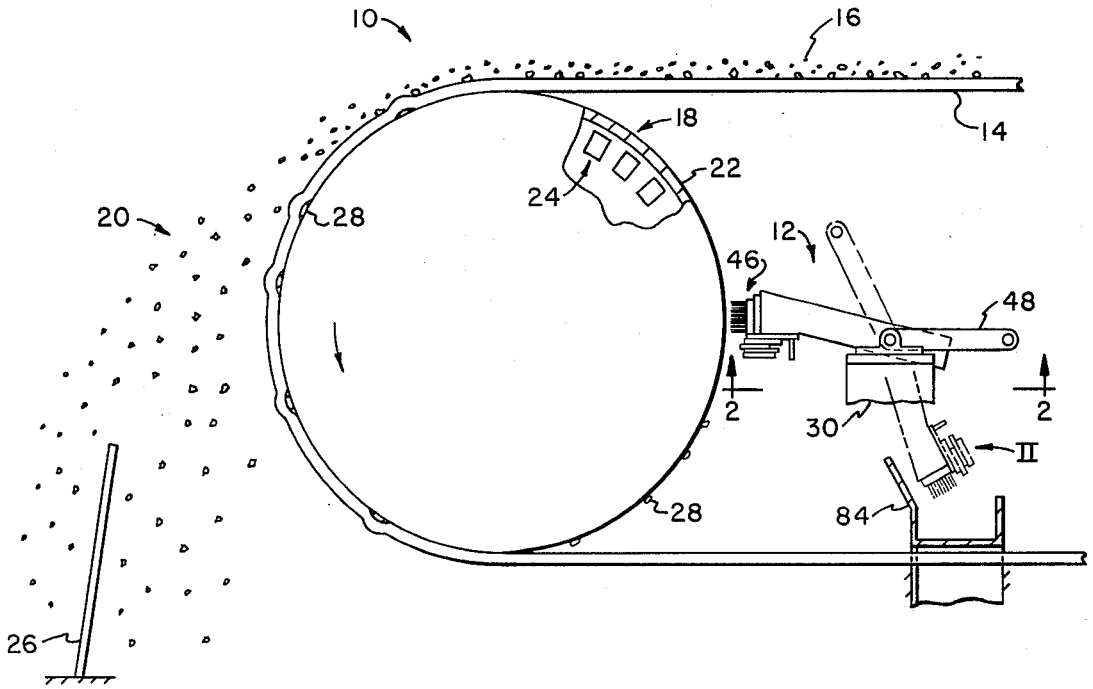
FIG. 1 is a side elevation and partial cut away view of a dry magnetic particle separation apparatus provided with the magnetic head pulley cleaning device.

Referring now to the drawings wherein the showings are for purposes of illustrating the present preferred embodiment of the invention only and not for purposes of limiting same, the figures show a dry magnetic particle separator 10 provided with an adherent particle cleaning apparatus generally designated as 12.

More particularly and with reference to FIG. 1, there is shown a continuously moving conveyor belt 14 which transports magnetic particles, for example taconite crude ore or the like, 16 over a magnetic head pulley 18 to a separation area generally designated as 20. The magnetic head pulley 18 consists essentially of a non-magnetic stainless steel drum 22 having a source of permanent magnetic or electromagnetic attractive force, such as 24, disposed within the drum 22. The particular magnetic source is not pertinent herein and may consist of either an electromagnetic means or permanent magnets which are disposed axially, as shown in the cut-away portion of FIG. 1, or circumferentially with respect to the drum peripheral surface. A splitting device 26 is provided in separation area 20 to separate the particles discharged by the belt 14 as to content of magnetic material, for example magnetite, in the following manner. The ore particles which contain relatively large quantities of magnetite, or any magnetically attractable material, are attracted to the head pulley 18 by the magnetic means 24 disposed therein and are discharged from the belt 14 a distance placing them in closer proximity to the head pulley 18 than the relatively non-magnetic fraction. The splitting device 26 serves to separate the discharged material according to the distance the particles are thrown from head pulley 18 thereby separating the discharge according to magnetic attractability and hence the magnetite content of the mixture.

During operation of the separator 10, particles 28 are attracted to and become attached to drum 22 and contact belt 14 as discussed above thus necessitating the removal of such particles 28.

Figure 2:
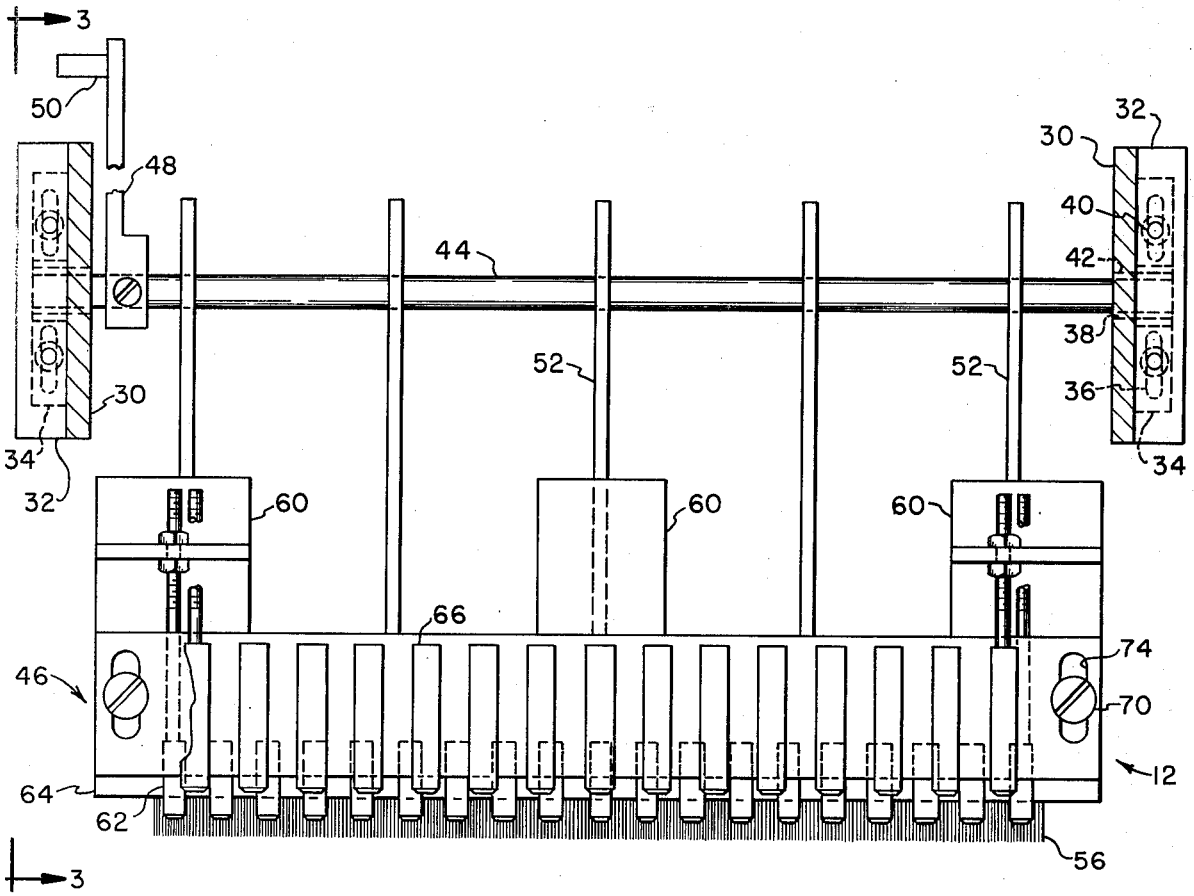
FIG. 2 is a bottom view of the magnetic head pulley cleaning device taken along section lines 2—2; and, FIG. 3 is a more detailed side elevation side view of the magnetic head pulley cleaning device.
Figure 3:
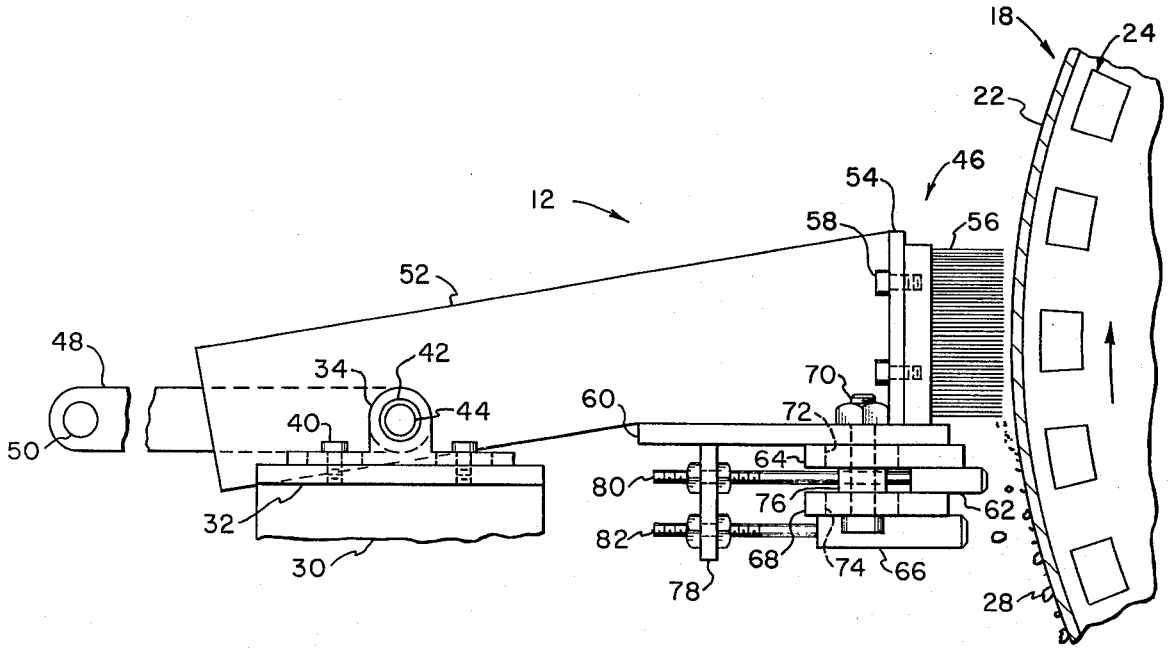
Figure 4:
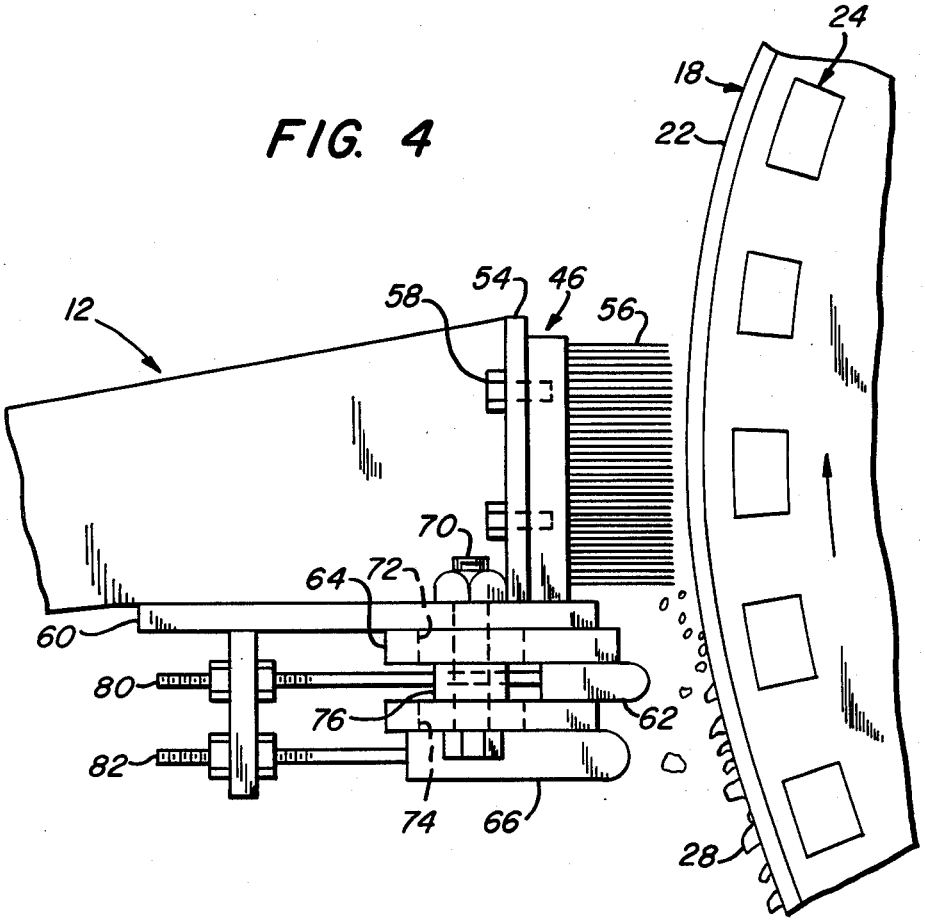
FIG. 4 is a detailed view of one aspect of a particular configuration of the present invention.
Figure 5:
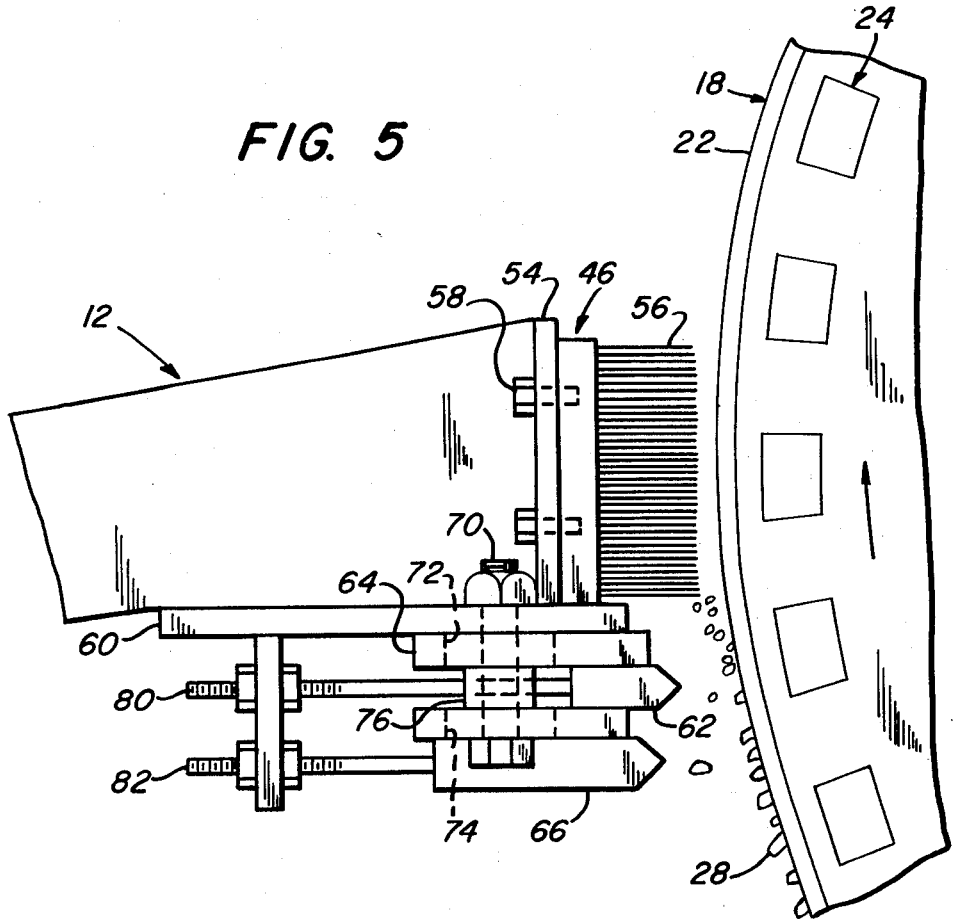
FIG. 5 is a detailed view of one aspect of another configuration of the present invention.

Before describing the cleaning apparatus 12 in detail, the materials preferred in its construction will be discussed. Preferably, all components of the cleaning apparatus 12, except those otherwise specified, are constructed from materials which are not attracted by a magnet when in proximity therewith, herein referred to as non-magnetic. The only components of the cleaning apparatus 12 shown in FIG. 2 that are not constructed from a non-magnetic material are the cleaning tines 56, 62 and 66 which are described in further detail herein and are constructed from magnetically soft iron, or any material which is easily magnetized when in proximity to a magnet, but quickly loses any induced magnetism when removed from proximity with the magnet. If a soft iron tine comprises a pointed, bevelled or rounded rod, a magnetic field gradient occurs at the end thereof. Because the lines of force converge towards the soft iron tines, the magnetic attractive force is in the direction of the tines. Moreover, such attractive force may, if the tine is properly designed, draw particles from the magnet surface to the tines. Larger tines are provided to attract larger magnetic particles and smaller tines will attract smaller particles.

The magnetic particle cleaning apparatus 12 is supported parallel and in proximity to the circumferential surface of the drum 22 by means of frame 30. Weldedly attached to frame 30 are substantially horizontal plates 32 which serve as supports for the adjustable shaft supports 34. The shaft supports 34 are provided with elongated horizontal slots 36 in their lower portion and horizontal apertures 38 in their vertical portion. The shaft supports 34 are affixed to the plates 32 by means of bolts 40 which pass through the elongated slots 36 in the lower portion of the shaft supports 34.

The apertures 38 in the shaft supports 34 are provided with bushings 42 which rotatably support the shaft 44 in a position parallel to the axis of the drum 22. The shaft 44 serves as a support for the assemblage, generally designated as 46, of the operative components of the magnetic particle cleaning device 12, and is further configured to displace the assemblage 46 between the head pulley cleaning position I shown in FIG. 1 which is closely adjacent and normal to the surface of the drum 22 at an area thereof uncovered by the conveyor belt 14 and the particle discharge position II shown in dashed lines therein. In order to displace assemblage 46, shaft 44 is manually pivotable by means of arm 48 affixed to one end of shaft 44 and handle 50 provided on arm 48. The device also is provided with about one-fourth to one-half inch of end play on the shaft 44 so that the assemblage 46 may be alternately moved laterally along the axis of the shaft 44 in order to pick up particles that may not be quite properly positioned on the drum 22 to be picked up by the soft iron tines, 56, 62 and 66.

Radially affixed to shaft 44 are parallel bracket support bars 52 which consist of metallic bars configured to support the assemblage 46 which includes the cleaning elements 56, 62 and 66, described below, and their supporting structure. The fine cleaning element support bracket 54 is a metallic bar which extends parallel to and substantially the length of drum 22 and is affixed to the ends of the bracket support bars 52. The fine particle cleaning elements 56 consist of magnetically soft wire tines or wire bristles which are affixed to bracket 54 by means of bolts 58 so that, when in position I, elements 56 are disposed approximately one-thirty second of an inch from the drum 22.

Welded to the lower surfaces of alternating bracket support bars 52 are metallic plates 60 which serve as supports for the remainder of the magnetic particle cleaning elements. The medium size particle cleaning elements 62 consist of members which are magnetically soft pins between approximately one-fourth and three-fourths inches in diameter and approximately three inches long. These medium size elements 62 are welded to the medium element support bracket 64 approximately $\frac{3}{4}$ inch apart and are disposed in facing relation to and approximately $\frac{3}{4}$ inch from drum 22 when in position I. Preferably, the tips of the medium elements 62 are chamfered, rounded or pointed to achieve a tip diameter of approximately $\frac{1}{8}$ to $\frac{5}{8}$ inches to increase the magnetic field gradient induced at the tips of the elements 62.

Similarly, the large magnetic particle cleaning elements 66 are welded to the large element support bracket 68 in facing relation to drum 22 when in position I. Large elements 66 consist of members which are magnetically soft pins or rods usually between 1 and 3, and possibly up to 4, inches in diameter and approximately three inches long which are arranged on bracket 68 approximately one and one-half inches apart and are disposed approximately one and one-half inches from drum 22 when in position I. Preferably, the operative tips of the large elements 66 are chamfered, rounded or pointed to achieve a tip diameter of approximately ¾ to 1½ inches. This arrangement is designed to remove ore particles of about one and one-fourth inches in maximum particle size while larger tines and increased spacing between the drum and tines would be required for larger particles.

The medium element support bracket 64 and the large element support bracket 68 are affixed to the underside of plates 60 by means of bolts 70 which pass through slots 72 and 74 in the ends of the medium and large support brackets 64 and 68, respectively. Shims 76 are utilized on bolts 70 between bracket 64 and bracket 68 in order to maintain proper spacing therebetween. To adjustably restrain the medium elements 62 and the large elements 66, vertical adjusting plates 78 are weldedly affixed to the support plates 60. In order that the proximity of the elements 62 and 66 with respect to drum 22 may be adjusted, medium element adjusting bolts 80 and large element adjusting bolts 82 are provided to pass through respective apertures in the adjusting plates 78.

A discharge chute or box 84 is provided for the deposit of particles when the assemblage 46 is in Position II.

In order to achieve optimum drum 22 cleaning, the distance between the elements 56, 62 and 66 and the drum 22 may be adjusted to maintain the distance from the drum 22 at which the elements are respectively induced with the maximum amount of magnetic force. The small diameter tines 56 are adjusted with respect to drum 22 by loosening bolts 40 which secure shaft supports 34 and displacing the entire cleaning device 12 along slots 36 in shaft supports 34. The position of the medium elements or pins 62 is adjustable with respect to drum 22 by loosening bolts 70 and 80 and displacing the medium element support bracket 64 with respect to plates 60 and 78, respectively. Similarly, the large elements or rods 66 are adjustable with respect to drum 22 by loosening bolts 70 and 82 and displacing the large element support bracket 68 with respect to plates 60 and 78, respectively.

During normal operation of the magnetic particle separator when cleaning is not necessitated, the magnetic particle cleaning assemblage 46 is in the position II indicated by the dashed lines in FIG. 1. However when cleaning of the magnetic belt head pulley is necessitated the magnetic particle cleaning assemblage 46 is manually pivoted into position I in proximity with the magnetic belt head pulley 18 by means of the handle 50 on the arm 48. When in the cleaning position I, lines of magnetic flux are generated from the magnet source 24 in the magnetic belt head pulley 18 to the soft iron cleaning elements 56, 62 and 66 which cause particles 28 of various sizes to be attracted from the magnetic head pulley 18 to the cleaning elements 56, 62 and 66, respectively. The elements 56, 62 and 66 are arranged so that when in position I the entrained particles 28 first encounter the large elements or rods 66, then medium elements or pins 62 and finally the fine elements or tines 56. This sequence is so arranged in order that larger adherent particles are removed first as they could not pass through the narrow clearance between the fine elements 56 and the head pulley 22 and would consequently tend to jamb the assemblage 46.

After a desired amount of magnetic particles have been attracted by the cleaning elements 56, 62, 66, the magnetic particles cleaning apparatus 12 is rotated back into position II and the magnetic particles fall from the cleaning elements 56, 62 and 66 onto discharge chute 84. Occasionally it is necessary to strike the cleaning apparatus 12 against the chute 84 in order to dislodge any particles 28 which may have become lodged between cleaning elements 56, 62, or 66. The above process is repeated until the magnetic head pulley 18 has been cleaned of the desired amount of magnetic particles 28.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. Apparatus for removing adherent magnetically attractable particles comprising:

a. a surface to which the particles are attracted;

b. source of magnetic force disposed beneath said surface;

c. a cleaning assemblage operatively disposed in relation to said surface, said cleaning assemblage comprising bracket means and a plurality of magnetically soft tines of varying diameters to affect attraction of particles of varying sizes respectively, each of said tines being affixed by one end thereof to said bracket means; and, d. means for moving said assemblage into a first position in which said tines are disposed substantially normal to said surface and in close proximity with said surface so as to cause said magnetic force to be concentrated on said tines to attract said adherent particles to said tines, and for moving said assemblage to a second position away from said surface for the discharge of the particles from said tines.

2. Apparatus according to claim 1 in which said tines comprise magnetically soft iron.

3. Apparatus according to claim 2 in which the ends of said tines which are nearest said surface when said assemblage is in said first position and are opposite from the ends of said tines which are affixed to said bracket means are chamfered, rounded or pointed.

4. Apparatus according to claim 3 in which said bracket means includes means for adjusting the proximity of said tines to said surface when said assemblage is in said first position.

5. Apparatus according to claim 4 in which said means for moving said assemblage comprises:

a. a frame;

b. a shaft rotatably mounted on said frame;

c. means affixed to said shaft for supporting said assemblage; and, d. means connected to said shaft for rotating said shaft to displace said assemblage between said first position and said second position.

6. The apparatus according to claim 5 in which said shaft is mounted on said frame so as to provide lateral movement of said shaft in the direction of the axis of said shaft.

7. The apparatus according to claim 6 in which said means for rotating said shaft comprises:

a. an arm affixed to one end of said shaft; and, b. handle means affixed to said arm operably disposed for manually imparting rotating movement to said arm and said shaft.

8. Apparatus according to claim 7 which includes a discharge means operatively disposed to receive said attracted particles when said assemblage is in said second position.

9. Apparatus according to claim 8 in which all components other than said tines comprise a non-magnetic material.

10. An apparatus for separating magnetically attractable particles from particles which are not magnetically attractable which comprises:

a. a continuously moving conveyor belt operably disposed to carry a mixture of said particles to a deposit point;

b. a head pulley having an outer surface operatively engaging said conveyor belt such that said conveyor belt is disposed about said head pulley so as to define upper and lower sections of said conveyor belt, said head pulley being provided with a source of magnetic force operative to radially attract said magnetically attractable particles passing on said conveyor belt over said head pulley; and, c. means for removing said magnetically attractable particles which have become adhered to said outer surface of said head pulley while said conveyor belt is moving, said removal means comprising:

i. a cleaning assemblage effective to attract said particles to said assemblage; and ii. means for moving said assemblage into a first position interposed between said upper and lower sections of said conveyor belt which pass over said head pulley and adjacent said outer surface of said head pulley so that in said first position said cleaning assemblage is disposed in close proximity to and substantially normal to said surface for attracting said adherent particles to said cleaning assemblage and for moving said cleaning assemblage to a second position away from said surface for discharge of the attracted particles from said cleaning assemblage.

11. Apparatus according to claim 10 in which said cleaning assemblage comprises a bracket means and a plurality of magnetically soft tines each affixed by one end thereof to said bracket means such that when said cleaning assemblage is in said first position said tines will be operably disposed in close proximity and substantially normal to said surface.

12. Apparatus according to claim 11 in which said tines are of varying diameters to effect attraction of particles of varying sizes respectively.

13. Apparatus according to claim 12 in which said tines comprise magnetically soft iron.

14. Apparatus according to claim 13 in which the ends of said tines which are nearest said surface when said assemblage is in said first position and are opposite from the ends of said tines which are affixed to said bracket means are chamfered, pointed or rounded.

15. Apparatus according to claim 14 in which said bracket means includes means for adjusting the proximity of said tines to said surface when said assemblage is in said first position.

16. Apparatus according to claim 15 in which said means for moving said assemblage comprises:

a. a frame;

b. a shaft rotatably mounted on said frame;

c. means affixed to said shaft for supporting said assemblage; and, d. means connected to said shaft for rotating said shaft to displace said assemblage between said first position and said second position.

17. The apparatus of claim 16 in which said shaft is mounted on said frame so as to provide lateral movement of said shaft in the direction of the axis of said shaft.

18. Apparatus according to claim 17 in which said means for rotating said shaft comprises:

a. an arm affixed to one end of said shaft; and, b. handle means affixed to said arm operably disposed for manually imparting rotating movement to said arm and said shaft.

19. Apparatus according to claim 18 which includes a discharge means operatively disposed to receive said attracted particles when said assemblage is in said second position.

20. Apparatus according to claim 19 in which all components of said means for removing adherent particles from said outer surface of said head pulley other than said tines comprise a non-magnetic material.

* * * * *